United States Patent [19]

Burdick

[11] Patent Number: 4,762,967

[45] Date of Patent: Aug. 9, 1988

[54] MODULAR PUSH TYPE LATCHING AND CROSS CANCELLING SWITCHES

[75] Inventor: Robert C. Burdick, Romulus, Mich.

[73] Assignee: United Technologies Automotive, Inc., Dearborn, Mich.

[21] Appl. No.: 69,134

[22] Filed: Jul. 2, 1987

[51] Int. Cl.[4] ..... H01H 9/26

[52] U.S. Cl. ..... 200/50 C

[58] Field of Search ..... 200/153 J, 50 C, 5 B

[56] References Cited

U.S. PATENT DOCUMENTS

| | | | |
|---|---|---|---|
| 2,933,578 | 4/1960 | Hubbell et al. | 200/156 |
| 2,950,372 | 8/1960 | Aspinwall | 200/156 |
| 2,965,737 | 12/1960 | Lewis et al. | 200/156 |
| 3,045,501 | 7/1962 | Wright | 74/142 |
| 3,375,337 | 3/1968 | Barrett et al. | 200/156 |
| 3,513,278 | 5/1970 | Elliott | 200/156 |
| 3,643,043 | 2/1972 | Endow | 200/16 F |
| 4,112,278 | 9/1978 | Greiner et al. | 200/156 |
| 4,213,017 | 7/1980 | Lewis | 200/5 B |
| 4,520,241 | 5/1985 | Sandi et al. | 200/5 B |
| 4,524,248 | 6/1985 | Levko | 200/5 B |
| 4,575,590 | 3/1986 | Hattori et al. | 200/5 B |

*Primary Examiner*—Renee S. Luebke

[57] ABSTRACT

A modular push type latching and cross cancelling switch operated by manual push motions. A pair of displaceable contact carriers (150, 250) are slidably mounted within an enclosure and have multiple positions for making electrical contacts. Rotatable cams (170, 270) are positioned adjacent each contact carrier and via selected camming surfaces control the position of the contact carriers. A pair of cam actuators (130, 230) are displaced by push motions and include contact surfaces for engaging each of the rotatable cams to displace the cam to cause one contact carrier to be placed in the desired "on" or "off" position and to place the other contact carrier in the "off" position if it was in the "on" position.

14 Claims, 3 Drawing Sheets

MODULAR PUSH TYPE LATCHING AND CROSS CANCELLING SWITCHES

CROSS REFERENCE TO RELATED APPLICATIONS

This application relates to commonly assigned copending U.S. patent application Ser. No. 69,127, entitled "A Latching Switch Operated by Sequential Push Motions", and U.S. patent application Ser. No. 69,135, entitled "A Switch Position Indicator".

TECHNICAL FIELD

The field to which this invention pertains is the field of electrical switches and, specifically, to modular push type latching and cross cancelling switches.

BACKGROUND OF THE INVENTION

The present invention is directed to a modular push type latching and cross cancelling pair of switches suitable for use in an automobile or other applications. The invention uses a combination of modular contact carriers, rotatable cams, and cam actuators for effecting displacement of contact carriers between "on" and "off" positions. The cross cancelling feature is obtained by selectively placing one contact carrier in an "off" position when the other contact carrier is placed in the "on" position. An interference tab extending from one contact carrier is used to prevent an actuator tongue of the cam actuator from engaging the other rotatable cam to effect displacement of the other contact carrier when both are in the "off" position. When one contact carrier is in the "on" position and it is desired to energize the other contact carrier, then displacement of the cam actuator will act to displace the other contact carrier to the desired "on" position and upon release of the cam actuator, the secondary portion of the cam actuator engages the rotatable cam which will control the contact carrier which is desired to be placed in the "off" position.

The prior art devices have utilized various mechanisms for controlling cross cancelling in switches.

The basic latching switch as used herein is combined in pairs such that the cross cancelling may be effected. The herein described switches are designed and are made particularly suitable for modular applications wherein identical parts may be substituted between the various switch elements.

The cam as utilized may be rotated in either direction. The sliding contact carriers are placed adjacent to each other and are simply reversed in orientation to achieve the desired effect. The cam actuators are the identical parts mounted adjacent each other with opposing orientations and common sliding areas to allow for sliding displacement between the two while obtaining the operation of the one contact carrier and the cross cancelling when the other contact carrier is in the "on" position.

SUMMARY OF THE INVENTION

It is an object of the present invention to provide a latching and cross cancelling switch.

It is a yet further object of the present invention to provide an electrical switch which is compact and readily adapted for modular construction.

It is a still further object of the present invention to provide a push-push type switch suitable for automotive applications and having a cam mechanism which may be operated in either rotational direction.

Another object of the present invention is to provide a safe, economical, reliable, easy to manufacture and assemble switch.

Other objects will be apparent from the description to follow and the appended claims.

The above objects are achieved according to a preferred embodiment by the provision of a plurality of push type latching switches which are capable of cross cancelling. The switches include a first contact carrier mounted for sliding displacement including a contact carrier cam surface and an interference tab; a second contact carrier mounted in juxtaposition to the first contact carrier for sliding displacement and including a contact carrier cam surface and an interference tab; a first rotatable cam mounted adjacent the first contact carrier including cam surfaces coacting with the first contact carrier cam surface for controlling the position of the first contact carrier and rib means by which the first rotatable cam may be rotated; a second rotatable cam mounted adjacent to the second contact carrier including cam surfaces coacting with the second contact carrier cam surface for controlling the position of the second contact carrier and rib means by which the second rotatable cam may be rotated; a first cam actuator including a primary actuator tongue and spaced therefrom a secondary actuator tongue, said primary actuator tongue being positioned to engage the rib means of the first rotatable cam and said secondary actuator tongue being positioned to engage the rib means of the second rotatable cam; and a second cam actuator including a primary actuator tongue and spaced therefrom a secondary actuator tongue, said primary actuator tongue being positioned to engage the rib means of the second rotatable cam and the secondary actuator tongue being positioned to engage the rib means of the first rotatable cam whereby upon displacement of one cam actuator one or both of said contact carriers may be displaced by the interaction of the cam actuator of the first and second rotatable cams.

Further disclosed is a modular push-push latching and cross cancelling switch which includes a pair of contact carriers mounted side by side for reciprocating motion between an "off" position and an "on" position, each contact carrier including a cam surface and extending interference tab; a pair of rotatable cams, one positioned adjacent each contact carrier cam surface for controlling the position of the contact carrier; and a pair of separately actuatable cam actuators, each of said cam actuators including primary means for engaging one of said rotatable cams to effect displacement of said cam and said corresponding contact carrier upon appropriate manual displacement of said cam actuator and each cam actuator including secondary means for engaging the other of said rotatable cams to effect displacement thereof, but only when the contact carrier having the interference tab extending therefrom is in the "on" position.

PREFERRED EMBODIMENT OF THE INVENTION

The herein invention will be described with reference to a particular embodiment. It is to be understood that the embodiment is designed for maximum modularity of components and that similar switching arrangements may make use of the same basic ideas as presented herein. It is further to be understood that other mounting arrangements, more positions than just the "on" and "off" positions and the rotating cam having more or less surfaces would all be within the contemplated scope of the herein invention. Other modifications will be apparent from the description that follows.

Figure 1:
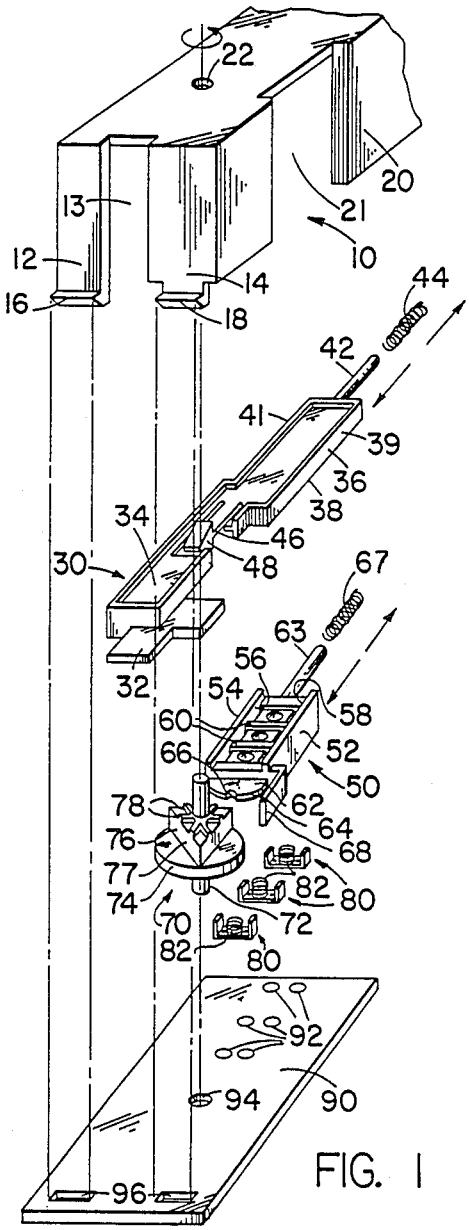
FIG. 1 is an exploded view of a latching switch.

Referring to FIG. 1, there may be seen an exploded view of a latching switch. Housing 10 is shown having legs 12 and 14, each with retaining surfaces 16 and 18, pivot opening 22 and body 20. Retaining surfaces 16 and 18 are designed to engage the leg openings 96 in printed circuit board base 90. When assembled, printed circuit board base 90 and housing 10 collectively define enclosure 21 therebetween. Contacts 92 are shown mounted to the printed circuit board base 90 and are the electrical contacts with which the contacts on contact carrier 50 will mate. Additionally, post opening 94 is shown for the receipt of the alignment post of the cam within the printed circuit board.

Contact carrier 50 as shown is generally rectangular in configuration and includes side plates 52 and 54 which respectively have interior sliding surfaces 58 and 56. The contact carrier further has top surfaces 60 all of which, the sliding surfaces and the top surfaces, effectively define a channel in which the sliding portion of the cam actuator may reciprocate.

Cam 62 is mounted at one end of the contact carrier and includes cam surfaces 64 and detent 66. Additionally, interference tab 68 is shown extending from the end of the contact carrier. In order to bias the contact carrier, a spring retainer 63 extends from the end of the contact carrier and spring 67 is mounted thereabout such that the spring is placed in compression between the housing and the remainder of the contact carrier upon displacement of the contact carrier, and hence urges the contact carrier in the opposite direction. Electrical contacts 80 mounted with springs 82 to the contact carrier extend downwardly therefrom positioned to engage contacts 92 of the printed circuit board base.

Rotating cam 70 is shown mounted adjacent the end of contact carrier 50. Rotating cam 70 includes alignment post 72 by which the rotating cam is secured to the printed circuit board base and to housing 10 for rotational movement. Rotating cam 70 further includes support cylinder 74, cam surfaces 76 formed in cam body 77 and cycling ribs 78. Cam surfaces 76 contact cam surface 64 of the contact carrier to effect appropriate displacement of the contact carrier in the indicated directions.

Shown immediately above the contact carrier is cam actuator 30. Cam actuator 30 includes push button 32 which extends through push button slot 13 as defined between legs 12 and 14 in the housing and is connected to actuator body 34 and actuator sliding portion 36. Sliding portion 36 has side surfaces 39 and 41 which are designed to engage sliding surfaces 58 and 56 of the contact carrier. Additionally, sliding portion 36 has sliding surface 38 formed at the bottom thereof which mates with top surfaces 60 of the contact carrier such that collectively the surfaces define a sliding channel such that the cam actuator is slidably secured within the contact carrier.

Cam actuator 30 additionally includes spring retainer 42 and spring 44 mounted thereon for biasing the cam actuator in a predetermined direction. The cam actuator further has actuator tongue 48 mounted to actuator tongue support 46 secured to the actuator body. The actuator tongue has surfaces which act to engage the cycling ribs of rotating cam 70 to effect displacement thereof.

In FIG. 1, it may be seen that top sliding surfaces 60 as well as sliding surface 56 and 58 define a U-shaped channel or sliding channel into which the sliding portion of the actuator is received. Spring retainer 63 is provided at the end of the contact carrier. Cam surface 64 is generally semicircular in configuration and is at the end of cam 62. Detent 66 is a small opening centered at the end of the cam surface. Slide plates 52 and 54 on the edges of the contact carrier are also indicated.

Figure 2:
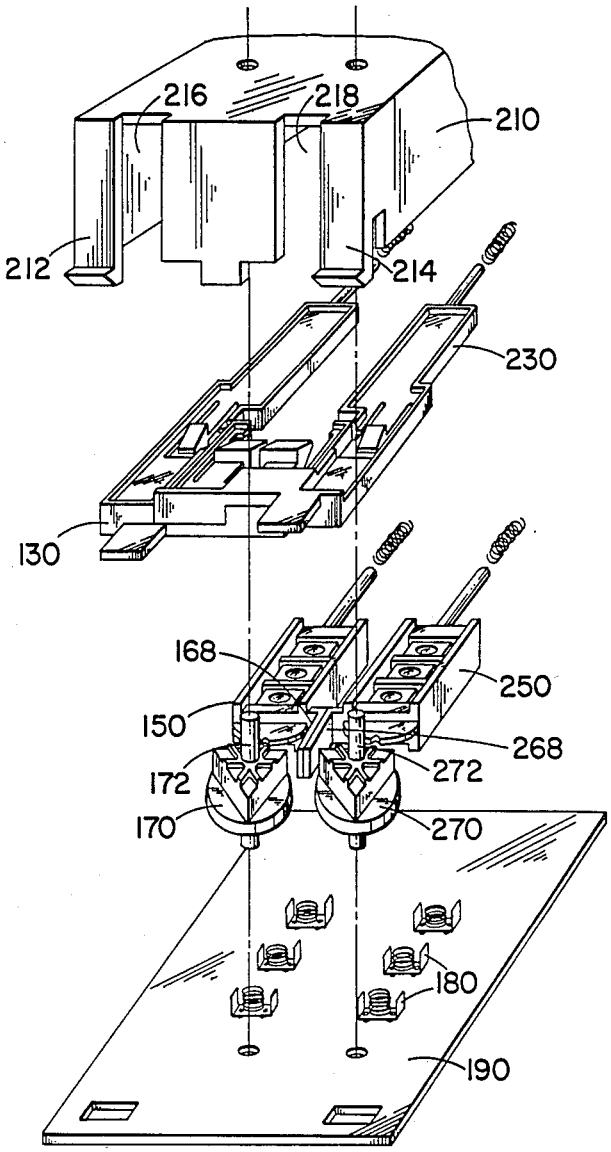
FIG. 2 is an exploded view of a modular push type latching and cross cancelling switch.

Referring more particularly to FIG. 2, there may be seen a modular push-push latching and cross cancelling switch(es). These modular switches are made from the same components as disclosed in FIG. 1, however, the cam actuator has been slightly modified to obtain the desired cross cancelling effect.

Housing 210 is shown having legs 212 and 214 extending downwardly therefrom and slots 216 and 218 into which the push buttons of cam actuators 130 and 230 may extend. Contact carriers 150 and 250 and rotatable cams 170 and 270, identical to the same components of FIG. 1, are provided. Interference tabs 168 and 268 extend outwardly from each contact carrier adjacent each other and adjacent the rotatable cams. When the contact carriers are in the "off" position as shown, the interference tabs prevent the secondary actuator tongue 104 (FIG. 5) from engaging the rotatable cam. When a contact carrier is in the "on" position, the interference tab is moved away from the cam such that the secondary actuator tongue may engage the cam to effect switching upon displacement of the appropriate cam actuator. In this manner, if one of the contact carriers is in the "on" position and the other cam actuator is displaced, the other cam actuator will be allowed to engage the cam to switch the contact carrier to the "off" position. If the contact carrier is in the "off" position and the cam actuator is displaced, the appropriate interfence tab will deflect the cam actuator tongue and the cam will not be switched to the "on" position. The printed circuit board 190 mates with housing 210 to define the enclosure in which the components are mounted. Electrical contacts 180 and the springs attached thereto are shown for mounting within contact carriers 150 and 250. Naturally, additional contacts or circuit board traces (not shown) will be provided on printed circuit board 190 forming the base of the enclosure such that upon appropriate displacement of the contact carriers, appropriate electrical connections are made.

As used herein, it will be indicated that the contact carriers are displaced between "on" and "off" positions. It is understood that this phraseology is not limited to two positions, but that, in fact, with the appropriate camming arrangements, the contact carriers may be placed in multiple positions.

Figure 3:
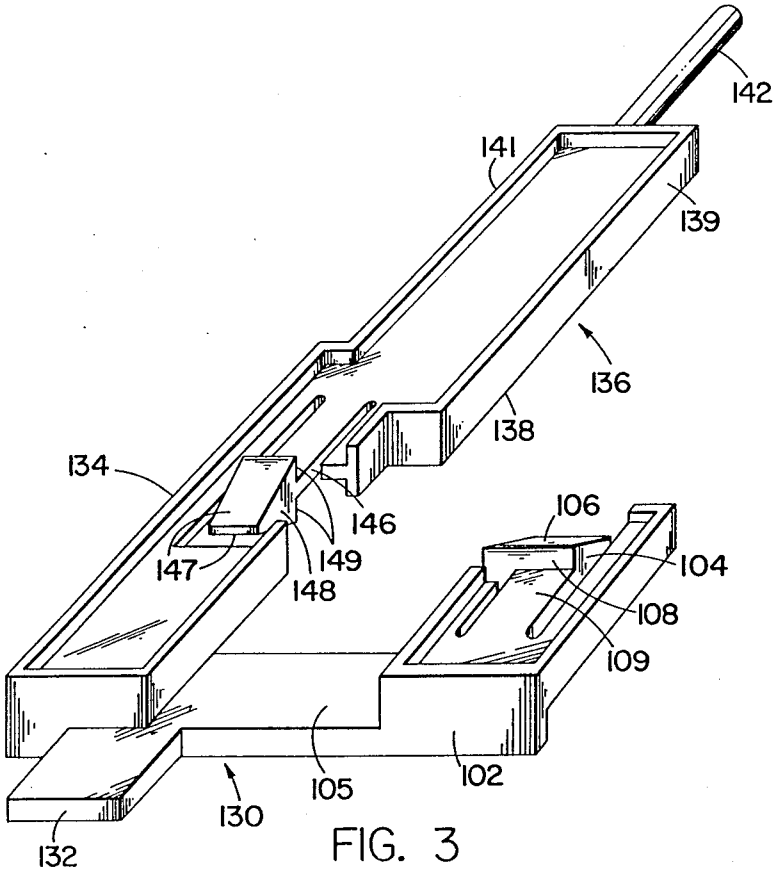
FIG. 3 is a perspective view of a cam actuator.

Referring to FIG. 3, it may be seen that cam actuator 130 includes push button 132, actuator body 134, sliding portion 136 and side surfaces 139 and 141. Spring retainer 142 is shown positioned to receive a spring for biasing the cam actuator in a preselected direction. Primary actuator tongue 148 is shown having inclined surfaces 147 and contact surfaces 149. The primary actuator tongue is connected to the actuator body via actuator tongue support 146.

Additionally shown as part of cam actuator 130 is secondary actuator portion 102 having tongue support 109, contact surface 108, inclined surface 106 and secondary actuator tongue 104. The sliding area portion 105 connects secondary actuator portion 102 to the primary actuator portion. When a pair of cam actuators as shown in FIG. 2 are placed adjacent each other in opposing relationships, it may be seen that the secondary actuator portion of one engages the sliding area portion of the other such that identical members in inverse relationship may be positioned adjacent each other.

Figure 4:
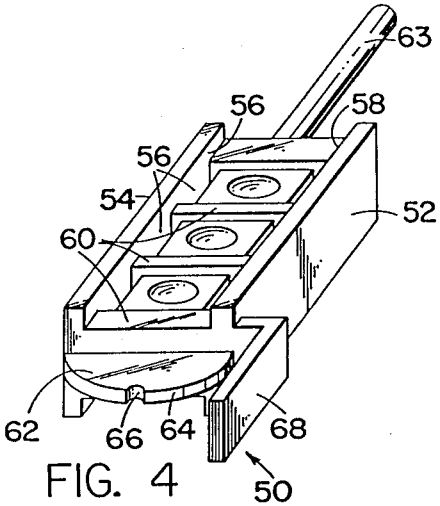
FIG. 4 is a perspective view of a contact carrier.
Figure 5:
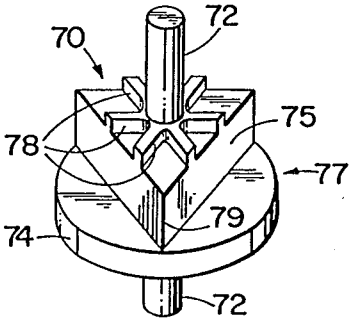
FIG. 5 is a perspective view of a rotatable cam.

Referring more particularly to FIGS. 4–5, basic components of the switch are shown in greater detail. Relative to FIG. 4, it can be seen that top sliding surfaces 60 as well as sliding surface 56 and 58 define a U-shaped channel or sliding channel into which the sliding portion of the actuator is received. Spring retainer 63 is provided at the end of the contact carrier. Cam surface 64 is generally semicircular in configuration and is at the end of cam 62. Detent 66 is a small opening centered at the end of the cam surface. Slide plates 52 and 54 on the edges of the contact carrier are also indicated.

Referring now to FIG. 5, rotating cam 70 may be seen. Alignment post 72 is shown extending from the top and bottom thereof for mounting the cam for rotational movement. The cam is shown having support cylinder 74 which may mate with the printed circuit board and serves to maintain the cam in alignment and to hold the contact carrier in position during assembly. The cam additionally has cam body 77 which includes planar cam surfaces 76 and pointed cam surfaces 79. As shown, there are three each pointed cam surfaces and the planar cam surfaces. Additionally, there are six cycling ribs 78 extending from the top of the cam body and arranged to have equal angular displacement therebetween. It is these cycling ribs 78 that contact surfaces 49 of the actuator tongue of the cam actuator engage to effect rotation thereof.

The invention has been described with reference to a particular embodiment herein, it will be understood by those skilled in the art that variations and modifications can be effected within the spirit and scope of the invention.

I claim:

1. A plurality of push type latching switches which are capable of cross cancelling which comprises:

a first contact carrier mounted for sliding displacement including a contact carrier cam surface and an interference tab;

a second contact carrier mounted in juxtaposition to the first contact carrier for sliding displacement and including a contact carrier cam surface and an interference tab;

a first rotatable cam mounted adjacent the first contact carrier and including cam surfaces coacting with the first contact carrier cam surface for controlling positioning of the first contact carrier and rib means by which the first rotatable cam may be rotated;

a second rotatable cam mounted adjacent to the second contact carrier and including cam surfaces coacting with the second contact carrier cam surface for controlling positioning of the second contact carrier and rib means by which the second rotatable cam may be rotated;

a first cam actuator including a primary actuator tongue and, spaced therefrom, a secondary actuator tongue, said primary actuator tongue being positioned to engage the rib means of the first rotatable cam and said secondary actuator tongue being positioned to engage the rib means of the second rotatable cam; and a second cam actuator including a primary actuator tongue and spaced therefrom a secondary actuator tongue, said primary actuator tongue being positioned to engage the rib means of the second rotatable cam and the secondary actuator tongue being positioned to engage the rib means of the first rotatable cam thereby upon displacement of one cam actuator one or both of said contact carriers may be displaced by interaction of the cam actuator with the first and second rotatable cams.

2. The apparatus as set forth in claim 1 and further comprising:

first bias means connected to the first cam actuator for biasing the first cam actuator to an at rest position; and second biasing means connected to the second cam actuator for biasing the second cam actuator to an at rest position.

3. The apparatus as set forth in claim 1 wherein the interference tab of the first contact carrier is positioned to prevent the secondary actuator tongue of the second cam actuator from engaging the first rotatable cam when the first contact carrier is in an at rest position and the interference tab of the second contact carrier is positioned to prevent the secondary actuator tongue of the first cam actuator from engaging the second rotatable cam when the second contact carrier is in an at rest position.

4. The apparatus as set forth in claim 3 wherein the interference tabs of the first and second contact carriers are positioned adjacent each other when both are in the at rest position.

5. The apparatus as set forth in claim 1 wherein the first contact carrier and the second contact carrier are identical with one of the two being mounted upside down relative to the other.

6. The apparatus as set forth in claim 1 wherein the first cam actuator further comprises the primary actuator tongue having inclined surfaces and contact surfaces, the contact surfaces engaging the rib means of the first rotatable cam when the cam actuator is displaced in a first direction and the inclined surface guiding the primary actuator tongue over the rib means of the first rotatable cam without displacement of the cam when the cam actuator is displaced in an opposite direction from the first direction.

7. The apparatus as set forth in claim 6 wherein the secondary contact carrier has an at rest position and wherein the first cam actuator further comprises the secondary tongue having inclined surfaces and contact surfaces, and when the secondary contact carrier is in the at rest position said inclined surfaces upon displacement of the first cam actuator in a first direction engage the interference tab of the second contact carrier and said secondary tongue is deflected to prevent engagement of the secondary tongue contact surface with the second rotatable cam upon displacement in the opposite direction; and when the secondary contact carrier is not in the at rest position said inclined surface guides the secondary actuator tongue over the rib means of the second rotatable cam without displacement of the cam when the second cam actuator is displaced in the first direction and said contact surfaces engage the rib means of the secondary rotatable cam to displace the rotatable cam when the secondary cam actuator is displaced in the opposite direction.

8. The apparatus as set forth in claim 1 wherein the first cam actuator and the second cam actuator comprise identical parts.

9. The apparatus as set forth in claim 1 wherein each cam actuator comprises a primary actuator portion which includes the primary actuator tongue, a secondary actuator portion which includes the secondary actuator tongue, a sliding area portion connecting the primary actuator portion to the secondary actuator portion and a push button.

10. The apparatus as set forth in claim 9 wherein the first cam actuator and the second cam actuator are positioned relative to each other with the secondary actuator portion of the second cam actuator slidably engaged to the sliding area portion of the first actuator and the secondary actuator portion of the first cam actuator slidably engaged to the sliding area portion of the second cam actuator.

11. Modular push-push latching and cross cancelling switches which comprise:

a pair of contact carriers mounted side by side for reciprocating motion between an "off" position and an "on" position each contact carrier including a cam surface and an extending interference tab;

a pair of rotatable cams, one positioned adjacent each contact carrier cam surface for controlling positioning of the contact carriers; and a pair of separately actuatable cam actuators, each of said cam actuators including primary means for engaging one of said rotatable cams to effect displacement of said cam and said corresponding contact carrier upon appropriate manual displacement of said cam actuator and each cam actuator including secondary means for engaging the other of said rotatable cams to effect displacement thereof, but only when the extending interference tab from the contact carrier adjacent the other of said rotatable cams is positioned distant from the other of said rotatable cams.

12. The apparatus as set forth in claim 11 and further comprising each secondary means having a secondary actuator tongue and each rotatable cam having cycling ribs which may be engaged to effect rotation thereof and wherein each secondary actuator tongue may engage the cycling ribs of one rotatable cam to effect displacement of the one rotatable cam.

13. The apparatus as set forth in claim 12 wherein the interference tab extending from the contact carrier is positioned to prevent the secondary actuator tongue from engaging the cycling ribs when the contact carrier is in the "off" position.

14. The apparatus as set forth in claim 13 and wherein when the contact carrier is in the "on" position, said secondary actuator tongue engages cycling ribs to displace the rotatable cam to allow the contact carrier to be moved to the "off" position in response to a manual displacement of the cam actuator to place the other contact carrier in the "on" position thereby cross cancelling to place one contact carrier in the "off" position when the other contact carrier is placed in the "on" position.

* * * * *